United States Patent [19]

Wilkes et al.

[11] Patent Number: 5,003,669

[45] Date of Patent: Apr. 2, 1991

[54] METHOD AND APPARATUS FOR REORIENTING SEED COTTON ON A GINNING APPARATUS

[75] Inventors: Lambert H. Wilkes, College Station; Martin Mehner, Lubbock, both of Tex.; William F. Lalor, Raleigh, N.C.

[73] Assignee: Cotton Incorporated, New York, N.Y.

[21] Appl. No.: 530,808

[22] Filed: May 30, 1990

[51] Int. Cl.[5] ..... D01B 1/06

[52] U.S. Cl. ..... 19/49; 19/48 R; 19/50

[58] Field of Search ..... 19/40, 48 R, 49, 50

[56] References Cited

U.S. PATENT DOCUMENTS

| | | | |
|---|---|---|---|
| 572,263 | 12/1896 | Libbey | 19/49 |
| 633,994 | 10/1899 | Graves | 19/50 |
| 1,002,598 | 9/1911 | McNally | 19/49 |
| 4,441,232 | 4/1984 | Underbrink et al. | 19/50 X |
| 4,779,309 | 10/1988 | Van Doorn | 19/50 |
| 4,934,029 | 6/1990 | Wilkes et al. | 19/48 R |

FOREIGN PATENT DOCUMENTS

| | | | |
|---|---|---|---|
| 545704 | 1/1975 | U.S.S.R. | 19/49 |

*Primary Examiner*—Werner H. Schroeder
*Assistant Examiner*—John J. Calvert
*Attorney, Agent, or Firm*—Burns, Doane, Swecker & Mathis

[57] ABSTRACT

An apparatus for processing seed cotton and removing fiber fractions from the seed cotton includes a plurality of freely rotatable first rollers that are arranged substantially parallel to one another and that are rotatably driven in a continuous path. A plurality of nip rolls are positioned in abutting relation to the first rollers on the side on the continuous path that is opposite to the side on which the seed cotton is deposited. The apparatus includes a reorienting arrangement for reorienting the position of the seed cotton on the first rollers to thereby permit all or substantially all of the fibers on the seed cotton to be removed. In one embodiment, the reorienting arrangement includes a rotating reorienting roller that contacts the seed cotton located on the first rollers. In another embodiment, the reorienting arrangement includes an apparatus that directs streams of air at the seed cotton on the first rollers.

16 Claims, 3 Drawing Sheets

METHOD AND APPARATUS FOR REORIENTING SEED COTTON ON A GINNING APPARATUS

FIELD OF THE INVENTION

The present invention relates to an apparatus and method for removing a fiber fraction from seed cotton. More particularly, the present invention concerns a method and apparatus for removing fiber fractions from seed cotton through use of a ginning apparatus and for reorienting the seed cotton on the ginning apparatus.

BACKGROUND OF THE INVENTION

Different types of arrangements have been proposed for ginning seed cotton. In one type of ginning apparatus described in U.S Pat. No. 4,441,232, which is assigned to the assignee herein, a plurality of first rollers are rotatably driven in a continuous path. At least one nip roller is positioned in abutting relation to the first rollers on the side of the continuous path opposite to the side that receives the seed cotton. A suction source acting through a suction duct draws air between adjacent first rollers from the side of the first rollers opposite to the side that receives the seed cotton. The suction source tends to draw at least a portion of the fiber fraction from the seed cotton between adjacent first rollers. The seed cotton moves in conjunction with the first rollers as the first rollers move in their continuous path and the fiber fraction drawn in by the suction source is nipped by the nip roll as the drawn in fiber fraction contacts the nip roll. The extended fiber fraction that is nipped by the nip roll is then removed from the apparatus through the suction duct.

Although the apparatus disclosed in the aforementioned patent is quite effective in removing fiber fractions from the seed cotton, that apparatus is susceptible of certain improvements. For example, it has been found through experimentation with the aforementioned ginning apparatus that the suction source which draws fiber fractions from the seed cotton also tends to hold the seed cotton against the first rollers in the same position that the seed cotton originally assumes when it is initially deposited on the first rollers. Consequently, as the seed cotton is carried along by the first rollers, the apparatus tends to remove fiber fractions from the same side of the seed cotton, namely the side of the seed cotton that is in contact with or closely adjacent to the first rollers. Thus, the portion of the fibers on the seed cotton that are not in contact with or located closely adjacent to the first rollers tend to remain on the seed cotton and are not drawn into the ginning apparatus by the suction force.

While it may be possible to increase the suction force in an attempt to draw the remaining fibers between the first rollers so that they can be nipped and removed by the nip rolls, such a solution may not be economically justifiable and may result in certain disadvantages. For instance, if the suction force is too great, the fiber fractions removed from the seed cotton may be removed in undesirably large clumps.

In light of the foregoing discovery relating to the aforementioned ginning apparatus, it would be desirable to provide the aforementioned ginning apparatus with an arrangement that would reorient the position of the seed cotton on the first rollers in order to help ensure that the fibers which are not in contact with or closely adjacent to the first rollers as the seed cotton is initially deposited on the first rollers will, nevertheless, be removed through operation of the ginning apparatus. In that way, all or substantially all of the fibers on the individual locks of seed cotton will be removed, thereby increasing the operating efficiency of the ginning apparatus and precluding the need for directing the seed cotton back to the ginning apparatus for further ginning.

OBJECTS AND SUMMARY OF THE INVENTION

One of the objects of the present invention is to provide an apparatus and method for removing a fiber fraction from seed cotton that is able to remove all or substantially all of the fibers from the individual locks of seed cotton.

Another object of the present invention is to provide an apparatus and method for removing a fiber fraction from seed cotton that is able to reorient the position of the individual locks of seed cotton on the first rollers after the seed cotton has been deposited on the apparatus.

It is an additional object of the present invention to provide an apparatus and method for removing a fiber fraction from seed cotton that is able to reorient the position of the individual locks of seed cotton on the first rollers and force the remaining fibers on the seed cotton between the first rollers to ensure that the remaining fibers are subjected to the nipping action of the nip rolls.

Those and other objects are accomplished by a method and apparatus according to the present invention. The apparatus includes a plurality of freely rotatable first rollers that are rotatably driven in a continuous path. The continuous path includes a first side for receiving seed cotton and an oppositely positioned second side. A plurality of nip rolls are also provided and each of the nip rolls has an outer peripheral surface that is positioned in abutting relation to the first rollers on the second side of the continuous path. The plurality of nip rolls include a first nip roll which is located closer than the other nip rolls to the point at which seed cotton is initially deposited on the first side of the continuous path in the direction in which the plurality of first rollers are rotatably driven, and a last nip roll which is located farther than the other nip rolls from the first nip roll in the direction in which the first rollers are rotatably driven. The apparatus also includes a reorienting device positioned adjacent the first rollers on the first side of the continuous path. The reorienting device is preferably located between the first nip roll and the last nip roll.

In one embodiment, the reorienting device includes a rotatably driven reorienting roller that is positioned in close proximity to the first rollers for contacting the seed cotton and reorienting its position on the first rollers. In another embodiment, an air nozzle arrangement is provided for directing a pressurized air stream toward the seed cotton located on the first rollers to reorient the position of the seed cotton on the first rollers and to force the remaining fibers on the seed cotton between the first rollers.

A method of processing seed cotton and removing fiber fractions from the seed cotton according to the present invention includes driving a plurality of spaced apart parallel first rollers along a continuous path, wherein the continuous path includes a first side for receiving seed cotton and an oppositely positioned second side that abuts a plurality of nip rolls, depositing seed cotton on the first rollers on the first side of the continuous path, removing fiber fractions from the seed cotton, and reorienting the position of the seed cotton on the first rollers to subject a different portion of the seed cotton to fiber fraction removal The step of reorienting the seed cotton on the first rollers takes place between a first nip roll that is located closer than the other nip rolls to the place at which seed cotton is initially deposited on the first rollers in the direction in which the first rollers are driven and a last nip roll which is located farthest from the first nip roll in the direction in which the first rollers are driven.

In the one embodiment, the position of the seed cotton is reoriented by contacting the seed cotton with a rotatably driven reorienting roller. In another embodiment, the step of reorienting the position of the seed cotton on the first rollers is performed by directing an air stream at the seed cotton disposed on the first rollers.

BRIEF DESCRIPTION OF THE DRAWINGS

Preferred embodiments of the present invention will be described in greater detail with reference to the accompanying drawings, wherein like elements bear like reference numerals and wherein.

DETAILED DESCRIPTION OF THE PREFERRED EMBODIMENTS

Figure 1:
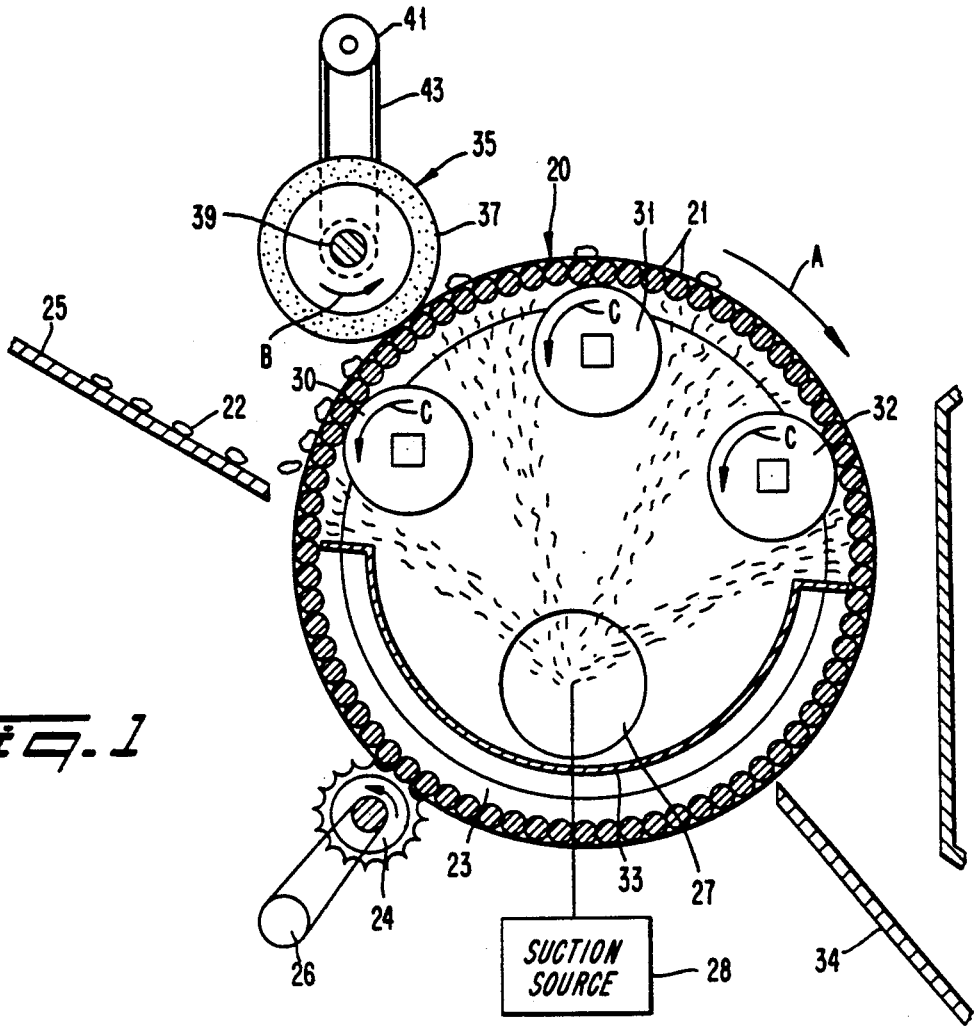
FIG. 1 is a cross-sectional view of the ginning apparatus illustrating one embodiment of the reorienting device according to the present invention.

Turning initially to FIG. 1, the apparatus for removing fiber fractions from seed cotton according to the present invention includes a cage roller apparatus 20 having a plurality of individually freely rotatable first rollers 21 that define a continuous circular path perpendicular to the axis of the first rollers 21. The continuous path has an outer surface (i.e., a first side) for receiving seed cotton. The first rollers 21 are arranged in a closely spaced relationship with respect to one another and are disposed substantially parallel to one another. The first rollers 21 are mounted on the inner periphery of a cage 23 and are mounted in a manner such that a small space is maintained between adjacent first rollers 21.

The cage 23 and the first rollers 21 are rotated in unison about the longitudinal axis of the cage 23 by any suitable device such as a toothed wheel 24 that contacts successive first rollers 21. The toothed wheel 24 is driven by a suitable driving device 26.

A plurality of nip rolls 30, 31, 32 are positioned within the cage 23. Although the drawings depict three nip rolls, any desired number of nip rolls, more or less than those shown, may be provided. Each of the nip rolls, 30, 31, 32 has a diameter that is relatively large in comparison to the diameter of each of the first rollers 21. The outer cylindrical peripheral surface of each of the nip rolls 30, 31, 32 abuts the inner surface (i.e., a second side) of the continuous path formed by the plurality of first rollers 21. In that way, the nip rolls, 30, 31, 32 exert a force against the first rollers 21.

One of the nip rolls 30 is positioned somewhat adjacent to an inclined feed apron 25. The inclined feed apron 25 serves to direct seed cotton 22 that is to be ginned onto the first side of the continuous path (i.e., the outer surface of the first rollers 21). The other nip rolls 31, 32 are positioned downstream from the one nip roll 30 in the direction of rotation A of the cage 23 and the first rollers 21. Although FIG. 1 depicts an inclined feed apron 25 for depositing seed cotton 22 onto the first rollers 21 on the first side of the continuous path, it is to be understood that any suitable type of apparatus could be provided for feeding and depositing the seed cotton onto the first rollers 21.

An outlet 34 is provided for collecting the seeds and any seed cotton that may not have been completely ginned as a result of the operation of the ginning apparatus.

A duct 27 that is connected to a suitable source of suction 28 is also positioned within the cage 23. The suction source 28 draws air radially inwardly between the adjacent first rollers 21 and thus, creates a force on the first rollers 21 that tends to hold objects to the first rollers 21 on the first side of the continuous path.

In operation, seed cotton 22 is deposited on the first side of the continuous path formed by the rotating first rollers 21. The seed cotton 22 is held against the first rollers 21 by the suction pressure developed on the inside of the first rollers 21 as a result of the operation of the suction source 28 through the suction duct 27. The suction force acting on the seed cotton 22 tends to draw at least a portion of the fiber fraction contained on the seed cotton 22 between adjacent first rollers 21. As the seed cotton 22 moves along with the rotating cage 23 and the first rollers 21, the fiber fraction extending between adjacent first rollers 21 is nipped by the first nip roll 30 such that the extended fiber fraction is removed from the seed cotton 22. The space between adjacent first rollers 21 is less than the diameter of the seeds and thus, the fiber fraction can be easily separated from the seed without also pulling the seed between the adjacent first rollers 21. The separated fiber fraction is conveyed by the suction pressure developed within the duct 27 and is removed from the apparatus through the duct 27.

After passing the first nip roll 30, the seed cotton 22 continues moving with the cage 23 and the first rollers 21 and a further fiber fraction may be drawn between adjacent first rollers 21 as a result of the suction pressure developed by the suction source 28 through the duct 27. As the seed cotton 22 progresses further around with the cage 23 and the first rollers 21, the extracted fiber fraction will be nipped by the next nip roll 31 and removed from the apparatus through the duct 27.

The seed cotton 22 will continue moving with the cage 23 and the first rollers 21 whereupon another fiber fraction may be drawn between adjacent first rollers 21 and thereafter, nipped by the next nip roll 32. If there are additional nip rolls, the above-described operation will continue until the seed cotton 22 passes the last nip roll. After passing the last nip roll, the seed cotton 22 will be at a position where a tangent to the outer surface of the cage 23 is substantially vertical. At that point, the seed cotton 22 will fall away from the first rollers 21 due to the force of gravity as well as the presence of an isolation flange 33 which prevents the suction pressure from holding the seed cotton 22 to the first rollers 21 at that position.

An apparatus and method for removing a fiber fraction from seed cotton of the type described above are disclosed in U.S. Pat. No. 4,441,232, the disclosure of which is incorporated herein by reference. It is to be understood that as an alternative to the circular arrangement of first rollers 21 shown in FIGS. 1-5, the first rollers 21 could be arranged to define an elongated continuous path such as disclosed in the aforementioned patent.

With further reference to FIG. 1, the apparatus 20 includes a reorienting arrangement 35 positioned outwardly with respect to the first rollers 21 on the first side of the continuous path. The reorienting arrangement 35 includes a rotatably driven reorienting roller 37 that is fixed to a centrally located shaft 39. The reorienting roller 37 extends substantially parallel to the first rollers 21 and is substantially the same length as the first rollers 21.

A suitable driving arrangement is provided for rotatably driving the reorienting roller 37. The driving arrangement may include a suitable driving device 41 and a drive belt 43 which connects the driving device 41 to the shaft 39 of the reorienting roller 37. The direction of rotation B of the reorienting roller 37 is the same as the direction of rotation C of the nip rolls 30, 31, 32 and is opposite to the direction of rotation A of the cage 23 and first rollers 21. Preferably, the outer peripheral surface of the reorienting roller 37 contacts the first rollers 21 on the first side of the continuous path. For reasons that will become apparent from the description of the operation of the apparatus that follows, the speed at which the reorienting roller 37 is rotatably driven is selected such that its peripheral speed is greater than the peripheral speed at which the first rollers 21 are rotatably driven.

Figure 2:
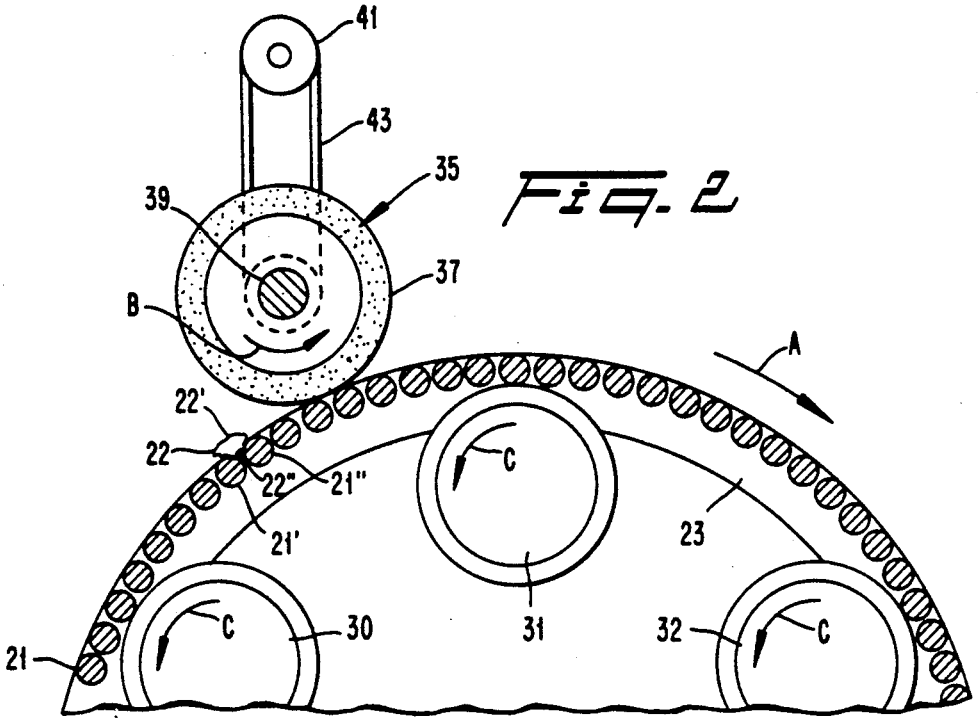
FIG. 2 is an enlarged cross-sectional view of a portion of the apparatus shown in FIG. 1 illustrating the operation of the reorienting device and the ginning apparatus.
Figure 3:
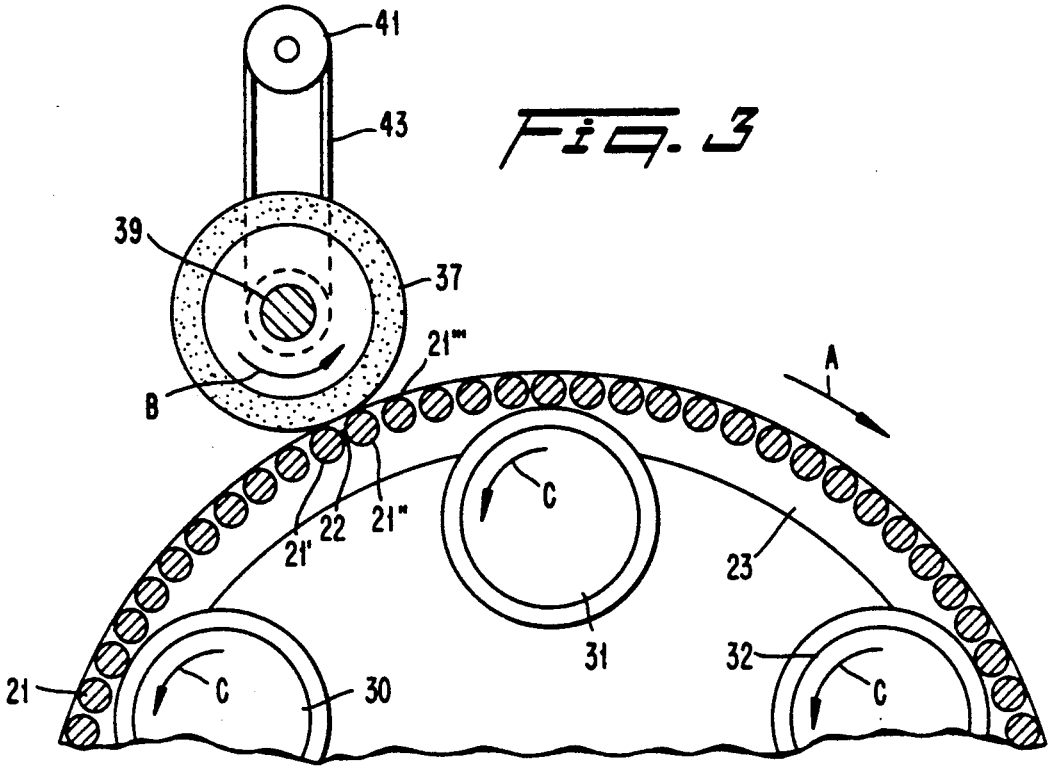
FIG. 3 is an enlarged cross-sectional view of a portion of the apparatus shown in FIG. 1 illustrating the operation of the reorienting device and the ginning apparatus.
Figure 4:
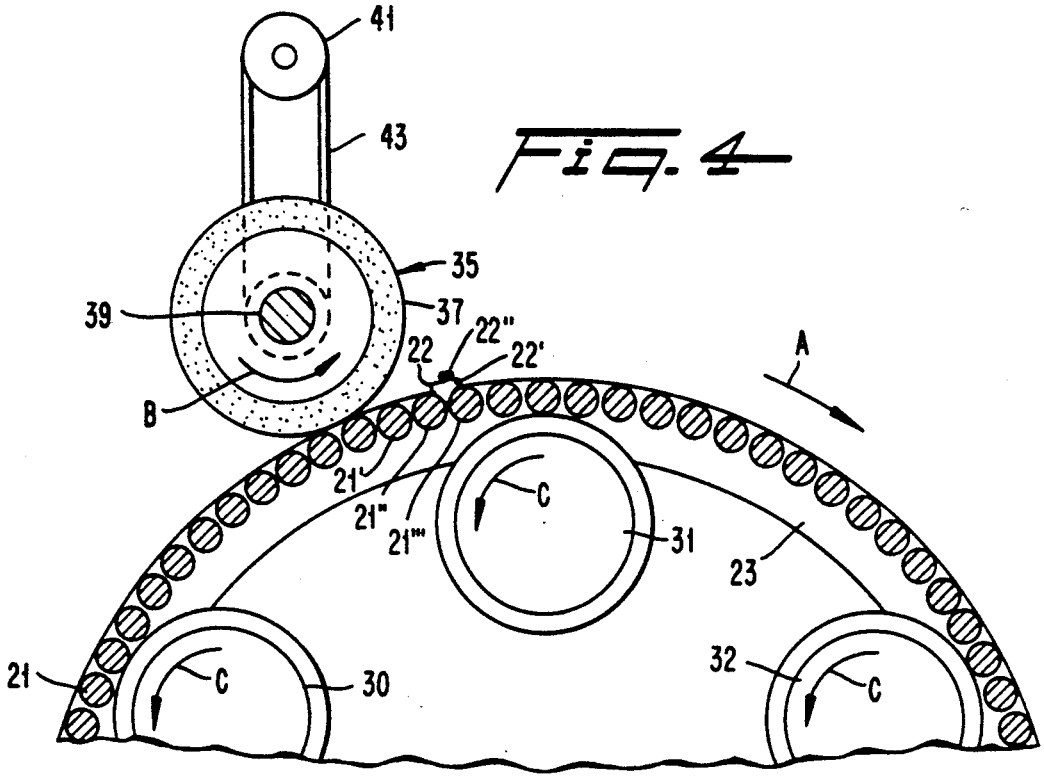
FIG. 4 is an enlarged cross-sectional view of a portion of the apparatus shown in FIG. 1 illustrating the operation of the reorienting device and the ginning apparatus.

During operation of the apparatus and with particular reference to FIGS. 2-4, seed cotton 22 that is initially deposited on the first rollers 21 on the first side of the continuous path is moved along with the rotation of the cage 23 and the first rollers 21. As shown in FIG. 2, a typical lock of seed cotton 22 that has been subjected to the nipping action of one or more nip rolls but which has not yet passed the reorienting roller 37 is located between two first rollers 21', 21''. The suction force developed within the cage 23 tends to hold the lock of seed cotton 22 against the first rollers 21 in substantially the same position that the seed cotton lock originally assumed when it was deposited on the first rollers 21. As a result, the fiber fractions which are removed from the seed cotton lock 22 tend to be removed from the side of the seed cotton lock 22 located in contact with or closely adjacent to the first rollers 21. Thus, after being subjected to the nipping action of one or more nip rolls, the remaining fibers 22' which are still attached to the seed 22'' are positioned away from the surface of the first rollers 21', 21''.

Moreover, after the fibers which are in contact with or in close proximity to the first rollers 21', 21'' are removed from the seed cotton lock 22, the partially exposed seed 22'' becomes situated between adjacent first rollers 21', 21''. That positioning of the seed 22'' tends to block the space between the adjacent first rollers 21', 21'' and thus, inhibits the remaining fiber 22'' from being drawn between the first rollers 21', 21'' so that it can be nipped at the next nip roll.

As the seed cotton 22 progresses further along with the rotating cage 23 and the rotating first rollers 21, the lock of seed cotton 22 will eventually be positioned between the rotating reorienting roller 37 and the two adjacently positioned first rollers 21', 21'' as seen in FIG. 3, whereby the reorienting roller 37 will contact the lock of seed cotton 22. Since the peripheral speed of the reorienting roller 37 is greater than the peripheral speed of the first rollers 21, the reorienting roller 37 will tend to impart a scrubbing motion to the lock of seed cotton 22. That scrubbing motion will cause the seed cotton lock 22 to be turned or flipped over and will also cause the seed cotton lock 22 to be moved across the one first roller 21''.

As seen in FIG. 4, after the seed cotton lock 22 has been turned over, moved across the first roller 21'' and thus, reoriented as a result of the reorienting roller 37, the seed cotton lock 22 is positioned between adjacent first rollers 21'', 21''' in such a manner that the remaining fibers 22' are in contact with or closely adjacent to the first rollers 21', 21'' while the seed 22'' is facing away from the first rollers 21', 21''. It is now possible to remove the remaining fibers 22' from the seed cotton lock 22 because the seed 22'' no longer blocks the passage between adjacent first rollers and because the remaining fibers 22' are in a position relative to the first rollers 21', 21'' that they can be easily drawn between the adjacent first rollers 21', 21'''. When the reoriented seed lock 22 encounters the next nip roll 31, fiber fractions which have been drawn between the first rollers 21'', 21''', can be nipped by the nip roll 31.

It can be seen from the above description that the reorienting arrangement 35 reorients the position of the seed cotton locks on the first rollers 21 to thereby help ensure that a maximum portion of the fibers on the seed cotton locks are removed through the operation of the ginning apparatus. In that way, the operating efficiency of the ginning apparatus is increased. Moreover, it is less likely that it will be necessary to collect partially unginned seed cotton at the outlet of the apparatus and redeposit it on the first rollers 21 for further ginning.

As mentioned above, the peripheral surface speed at which the reorienting roller 37 is rotatably driven is preferably greater than the peripheral surface speed at which the first rollers 21 are driven. By way of example, the peripheral surface speed of the reorienting roller can be 1.5 times the peripheral surface speed of the first rollers 21. To illustrate, the peripheral surface speed of the reorienting roller 37 may be approximately 300 feet per minute while the peripheral surface speed of the first rollers 21 may be approximately 200 feet per minute.

As shown in FIGS. 1-4, the reorienting roller 37 preferably contacts the first rollers 21 at some point between the first nip roll 30 which is located closer than the other nip rolls to the place where the seed cotton 22 is initially deposited on the first rollers 21 and the last nip roll 32 which is locate farther than the other nip rolls from the first nip roll 30 in the direction A in which the cage 23 and the first rollers 21 are rotatably driven. In that way, the seed cotton 22 will have had an opportunity to be subjected to the nipping action of at least one nip roll prior to encountering the reorienting effect of the reorienting arrangement 35. Also, the seed cotton 22 which has been reoriented as a result of the reorienting arrangement 35 will have an opportunity to be subjected to the nipping action of at least one nip roll.

Although FIGS. 1–4 illustrate the use of a single reorienting arrangement 35, it is to be understood that more than one reorienting arrangement could be provided if, for instance, it is found that further reorientation of the seed cotton is advantageous or necessary. Also, the reorienting arrangement 35 could be located at a position along the continuous path between the first and last nip rolls that is different from the position shown in FIGS. 1–4. For example, it may be desirable to position the reorienting arrangement 35 at a position such that when the seed cotton reaches the reorienting arrangement 35, the seed cotton has been subjected to the nipping action of two or more nip rolls, thereby ensuring that all or substantially all of the fibers on one side of the seed cotton lock have been removed prior to reorienting the seed cotton lock.

It should also be understood that it may be possible to space the reorienting roller 37 from the first rollers 21 by a very small distance. If the reorienting roller 37 is slightly spaced from the first roller 21, the spacing should be selected such that the ability of the reorienting roller 37 to impart a scrubbing action to the seed cotton 22 and thereby cause the seed cotton to be turned over and moved across the first roller 21 is not affected.

The outer peripheral surface of the reorienting roller 37 should preferably be manufactured from a material that is sufficiently durable to prevent puncture and abrasion from the seed cotton material. On the other hand, the material from which the reorienting roller 37 is fabricated should be pliable enough to help ensure that the seed is not crushed or otherwise damaged as it passes between the first rollers 21 and the reorienting roller 37 because the possibility exists that the crushed or damaged seed could pass between adjacent first rollers 21 and thereby be drawn into the suction duct 27.

Figure 5:
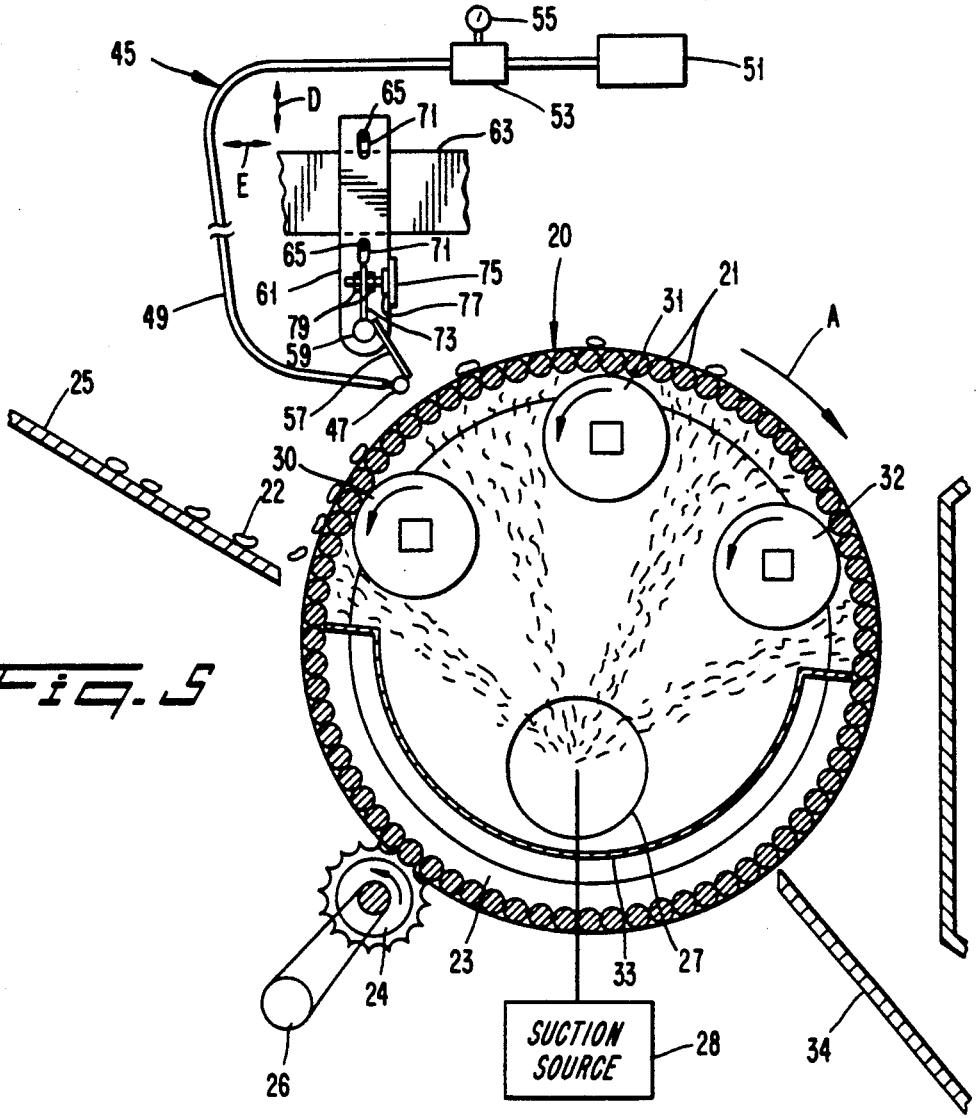
FIG. 5 is a cross-sectional view of the ginning apparatus illustrating another embodiment of the reorienting device according to the present invention.
Figure 6:
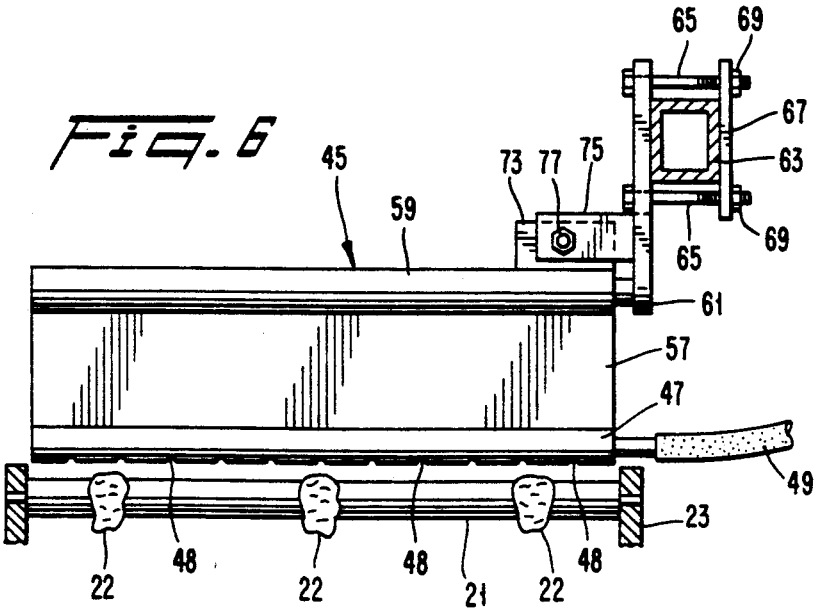
FIG. 6 is a top view of a portion of the apparatus shown in FIG. 1.

Turning now to FIG. 5, a reorienting arrangement 45 according to a second embodiment of the present invention includes a hollow tube 47 that is disposed substantially parallel to the first rollers 21 and that is substantially as long as the first rollers 21. The hollow tube 47 is connected to a hose 49. The hose 49 is connected to a source of air 51 for supplying air to the hollow tube 47. A pressure regulator 53 is positioned at any desired point along the length of the hose 49 for regulating the pressure of the air supplied to the hollow tube 47. Also, a pressure gauge 55 is connected to the pressure regulator 53 for displaying the pressure of the air being supplied to the hollow tube 47. As depicted in FIG. 6, the hose 49 is preferably connected to one end of the hollow tube 47. The opposite end of the hollow tube 47 is preferably closed.

Turning back to FIG. 5, the hollow tube 47 is secured to an interconnecting element 57 in any suitable manner. The interconnecting element 57 is connected to a shaft member 59. The shaft member 59 is rotatably mounted on a frame mounting member 61 and the frame mounting member 61 is movably mounted on a portion of the frame 63 of the apparatus. The frame mounting member 61 is movable in a direction D parallel to the longitudinal extent of the frame mounting member 61 (i.e. substantially horizontally as seen in FIG.5) as well as in a direction E perpendicular to the longitudinal extent of the frame mounting member 61 (i.e., substantially vertically as seen in FIG.5).

As seen in FIG. 6, the frame mounting member 61 is mounted on the frame 63 by way of bolts 65 and a backing plate 67. The bolts 65 extend through holes located in the frame mounting member 61 as well as through holes in the backing plate 67. The bolts 65 threadably engage nuts 69 located on the rear side of the backing plate 67. In order to adjust the position of the frame mounting member 61 and thus, the position of the hollow tube 47, the nuts 69 are loosened and the frame mounting member 61 is slid along the length of the frame 63 in the direction E perpendicular to the longitudinal extent of the frame mounting member 61 (i.e., in the horizontal direction as seen in FIG. 5).

The holes 71 in the frame mounting member 61 through which the bolts 65 extend are elongated in the direction D parallel to the longitudinal extent of the frame mounting member 61. In that way, the frame mounting member 61 and thus, the hollow tube 47 can be adjusted in the vertical direction D parallel to the longitudinal extent of the frame mounting member 61 by loosening the nuts 69, moving the frame mounting member 61 up or down and then tightening the nuts 69.

It should be recognized that an arrangement other than that described above and shown in FIGS. 5 and 6 could be provided for effecting movement of the nozzle 47 in the horizontal and vertical directions.

The reorienting arrangement 45 is also provided with an assembly for rotationally adjusting the position of the hollow tube 47 relative to the first rollers 21. A flange 73 is fixedly secured to the rotatable shaft 59 while a rigid plate member 75 is fixedly secured to and extends outwardly from one edge of the frame mounting member 61. The flange 73 has a hole extending therethrough through which a screw member 77 extends. The screw member 77 threadably engages two nuts 79 and has a screw head that contacts the rigid plate member 75. The nuts 79 are located on opposite sides of the flange 73.

Through proper manipulation of the nuts 79, the position of the head of the screw member 77 can be adjusted relative to the rigid plate member 75. In that way, the flange 73 which is secured to the rotatable shaft 59 is moved away from the rigid plate member 75 which causes the shaft member 59 and the attached hollow tube 47 to rotate in the counter clockwise direction. By operating the nuts 79 in an opposite manner, clockwise rotation of the shaft member 59 and the hollow tube 47 can be effected.

The construction of the hOse 49 as well as the manner in which the hose 49 is mounted with respect to the remaining parts of the apparatus causes the hose 49 to tend to pull the hollow tube 47 to the left as seen in FIG. 5, thereby maintaining the head of the screw member 77 in abutting relation with respect to the rigid plate member 75. It may be desirable in some instances to employ a spring member which biases the flange 73 and the head of the screw member 77 towards the rigid plate member 75.

As seen in FIG. 6, the hollow tube 47 includes a plurality of orifices 48 extending through the tube wall. The orifices 48 connect the interior of the tube 47 with the atmosphere. Preferably, the orifices 48 are arranged in a straight line that is parallel to the longitudinal axis of the hollow tube 47. The pressurized air that is fed into the hollow tube 47 from the air source 51 and the pressure regulator 53 is discharged through the orifices 48 and is directed towards the seed cotton 22 located on the first rollers 21.

During operation of the ginning apparatus depicted in FIGS. 5 and 6, seed cotton 22 is deposited on the first rollers 21 on the first side of the continuous path. The seed cotton progresses along with the movement of the case 23 and the first rollers 21 and fiber fractions which are drawn between adjacent first rollers 21 as a result of the suction created within the cage 23 are nipped by one or more nip rolls. As discussed above, the suction which draws fibers between adjacent first rollers 21 also tends to hold the seed cotton against the first rollers 21 in the same position that the seed cotton originally assumed when it was deposited on the first rollers 21, thus preventing the seed cotton from repositioning itself on the first rollers. As fibers are drawn between adjacent first rollers 21 and nipped by the nip rolls, the fibers in contact with or closely adjacent to the first rollers 21 will tend to be removed from the seed cotton while the fibers not in contact with the first rollers 21 will tend to remain on the seed cotton.

The reorienting arrangement 45 according to the second embodiment of the present invention is able to help ensure that the fibers remaining on the seed cotton 22 are subjected to the nipping action of the nip rolls by reorienting the position of the seed cotton 22 on the first rollers 21 at a suitable position along the continuous path. As the seed cotton 22 passes underneath the air streams from the orifices 48 in the hollow tube 47, the air streams impinge upon the seed cotton 22. The air streams reorient the locks of seed cotton on the first rollers and push the remaining fibers on the seed cotton locks between the adjacent first rollers 21. As the seed cotton 22 is turned and while the remaining fibers on the seed cotton 22 are being pushed between the adjacent first rollers 21, the suction pressure developed within the cage 23 draws the remaining fibers between the adjacent first rollers 21 so that they can be subjected to the nipping action of the nip rolls positioned downstream therefrom.

The ability of the reorienting arrangement 45 to reorient the position of the seed cotton 22 and push the remaining fibers between the adjacent first rollers 21 helps ensure that by the time the seed cotton reaches the exit point of the ginning apparatus, all or substantially all of the fibers have been removed from the seed cotton. In that way, the operating efficiency of the ginning apparatus is increased. Further, as noted above, the need for directing the seed cotton back to the surface of the ginning apparatus in order to subject the seed cotton to further ginning is substantially negated.

The adjustable nature of the hollow tube 47 through which the air streams are directed allows the hollow tube 47 to be positioned in a multiplicity of positions with respect to the seed cotton. For instance, it may be desirable in some instances to permit the seed cotton 22 to be subjected to further ginning action prior to being reoriented and in order to achieve that objective, the frame mounting member 61 can be moved upwardly, slid along the length of the frame 63 (to the right as seen in FIG. 5) and then fixed in place. Also, it may be desirable in some instances to vary the angle at which the air stream is directed at the seed cotton 22 and the rotatable nature of the hollow tube 47 allows that objective to be achieved.

As in the case of the reorienting arrangement 35 according to the first embodiment of the present invention, the reorienting arrangement 45 shown in FIGS. 5 and 6 should be positioned such that the air streams discharged from the hollow tube 47 are directed towards the seed cotton 22 when the seed cotton is at a position downstream from at least a first nip roll in the direction A of rotation of the first rollers 21 and upstream from a last nip roll which is located farthest from the first nip roll in the direction A of rotation of the first rollers 21. Thus, prior to being reoriented, the seed cotton 22 will have had an opportunity to be subjected to the nipping action of at least one nip roll. Moreover, after the seed cotton 22 has been reoriented, it will have an opportunity to be subjected to the nipping action of at least one more nip roll.

Of course, the reorienting arrangement 45 according to the second embodiment of the present invention could be positioned at a place different from that shown in FIG. 5. For example, the reorienting arrangement 45 could be positioned between the second nip roll 31 and the third nip roll 32, or between any two nip rolls, depending upon the number of nip rolls provided.

The pressure of the air supplied to the hollow tube 47 can vary depending upon various factors such as the size of the seed cotton locks. By way of example, the pressure supplied to the hollow tube 47 may be approximately 20 psi.

The principles, preferred embodiments and modes of operation of the present invention have been described in the foregoing specification However, the invention which is intended to be protected is not to be construed as limited to the particular embodiments disclosed. Further, the embodiments described herein are to be regarded as illustrative rather than restrictive. Variations and changes may be made by others without departing from the spirit of the present invention. Accordingly, it is expressly intended that all such variations and changes which fall within the spirit and scope of the present invention as defined in the claims, be embraced thereby.

What is claimed is:

1. An apparatus for removing a fiber fraction from seed cotton, comprising:

a plurality of freely rotatable first rollers arranged substantially parallel to one another, said plurality of first rollers being rotatably driven in a continuous path, said continuous path having a first side for receiving the seed cotton and a second side opposite said first side;

a plurality of nip rolls, each of which has an outer peripheral surface that is positioned in abutting relation to the first rollers on the second side of the continuous path for nipping fiber fractions extending between adjacent first rollers, said plurality of nip rolls including a first nip roll which is located closer than the remaining nip rolls to a point at which seed cotton is initially deposited on the first side of the continuous path in the direction of movement of said plurality of first rollers, and a last nip roll which is located farther than the remaining nip rolls from the first nip roll in the direction of movement of the plurality of first rollers; and reorienting means positioned adjacent the first rollers on the first side of the continuous path for reorienting the position of the seed cotton on the first rollers so that fibers remaining on the seed cotton can be subjected to the nipping action of a nip roll, said reorienting means being located between the first nip roll and the last nip roll.

2. The apparatus in accordance with claim 1, wherein said reorienting means includes at least one rotatable reorienting roller positioned with respect to the first rollers on the first side of the continuous path such that said reorienting roller contacts seed cotton located on the first rollers as the seed cotton passes between the reorienting roller and the first rollers.

3. The apparatus in accordance with claim 2, wherein said reorienting roller rotates at a peripheral surface speed that is greater than the peripheral surface speed at which the plurality of first rollers are rotatably driven.

4. The apparatus according to claim 2, wherein said plurality of nip rolls are rotatably driven, said plurality of nip rolls and said reorienting roller being rotatably driven in the same direction and said reorienting roller being rotatably driven in a direction opposite to the direction in which the plurality of first rollers are rotatably driven.

5. The apparatus according to claim 2, wherein said first rollers, said plurality of nip rolls and said reorienting roller extend substantially parallel to one another.

6. The apparatus according to claim 1, wherein said reorienting means includes a hollow tube having a plurality of spaced apart orifices extending through a wall thereof, said hollow tube being connected to an air source and said orifices being directed towards the first side of the continuous path so that streams of air will impinge on the seed cotton located on the first side of the continuous path and thereby reorient the seed cotton and force fibers remaining on the seed cotton between adjacent first rollers.

7. The apparatus according to claim 6, wherein said hollow tube is connected to the source of pressurized air by a hose, said hose including regulating means positioned at a point along its length for regulating the pressure of the air supplied to the hollow tube from the air source.

8. The apparatus according to claim 7, wherein said hollow tube is connected to a shaft by an interconnecting member, said shaft being rotatably mounted on a frame mounting member and said frame mounting member being movably mounted on a frame part of the apparatus, said frame mounting member being movably mounted with respect to the frame part in two directions that are substantially perpendicular to one another.

9. The apparatus according to claim 8, including a flange extending from the rotatable shaft, a threaded screw extending through a hole in the flange and having a head, and a nut located on each side of the flange, said nuts threadably engaging the screw and permitting the position of the screw head relative to the flange to be adjusted, said frame mounting member having a plate member extending therefrom, said plate member being positioned relative to said flange such that the screw head rests against the plate member.

10. An apparatus for removing a fiber fraction from seed cotton, comprising:

a plurality of freely rotatable first rollers arranged substantially parallel to one another, said plurality of first rollers being rotatably driven in a continuous path, said continuous path having a first side for receiving the seed cotton and a second side opposite the first side;

a plurality of nip rolls, each of which has an outer peripheral surface that is positioned in abutting relation to the first rollers on the second side of the continuous path for nipping fiber fractions extending between adjacent first rollers; said plurality of nip rolls including a first nip roll which is located closer than the remaining nip rolls to a point where seed cotton is initially deposited on the first side of the continuous path in the direction of movement of said plurality of first rollers, and a last nip roll which is located farther than the remaining nip rolls from first nip roll in the direction of movement of the plurality of first rollers;

a reorienting roller positioned in close proximity to the first rollers on the first side of the continuous path so that the reorienting roller will contact seed cotton located on the first rollers, said reorienting roller being located between the first nip roll and the last nip roll; and means for rotatably driving the reorienting roller in a direction opposite to the direction in which the plurality of first rollers are rotatably driven so that the rotating reorienting roller will contact and reorient the seed cotton on the first rollers and thereby permit fibers remaining on the seed cotton to be subjected to the nipping action of a nip roll.

11. An apparatus for removing fiber fractions from seed cotton, comprising:

a plurality of freely rotatable first rollers arranged substantially parallel to one another, said plurality of first rollers being rotatably driven in a continuous path, said continuous path having a first side for receiving the seed cotton and a second side opposite the first side;

a plurality of nip rolls, each of which has an outer peripheral surface that is positioned in abutting relation to the first rollers on the second side of the continuous path to thereby apply a force to the first rollers, said plurality of nip rolls including a first nip roll which is located closer than the remaining nip rolls to a point at which seed cotton is initially deposited on the first side of the continuous path in the direction of movement of the plurality of first rollers, and a last nip roll which is located farther than the remaining nip rolls from the first nip roll in the direction in which the first rollers are rotatably driven; and means located in close proximity to the first rollers on the first side of the continuous path for directing an air stream toward the first rollers in order to reorient the position of the seed cotton on the first rollers and force fibers on the seed cotton between adjacent first rollers, whereby fibers remaining on the seed cotton can be subjected to the nipping action of a nip roll.

12. The apparatus of claim 11, wherein said means for directing an air stream towards the first rollers includes a hollow tube having a plurality of orifices extending therethrough that are directed towards the first rollers, an air source connected to said hollow tube for supplying pressurized air to the hollow tube, means for rotatably adjusting the position of the hollow tube and means for adjusting the position of the hollow tube in two directions which are substantially perpendicular to one another.

13. A method of processing seed cotton, comprising the steps of:

driving a plurality of spaced apart parallel first rollers along a continuous path, said continuous path having a first side for receiving seed cotton and an oppositely positioned second side that abuts a plurality of nip rolls which serve to nip fiber fractions extending between adjacent first rollers;

depositing seed cotton on the first rollers on the first side of the continuous path;

removing fiber fractions from the seed cotton; and reorienting the position of the seed cotton on the first rollers to subject a different portion of the seed cotton to fiber fraction removal, the step of reorienting the seed cotton taking place between a first nip roll which is located closer than the remaining nip rolls to the place at which seed cotton is initially deposited on the first rollers in the direction in which the first rollers are driven and a last nip roll which is located farthest from the first nip roll in the direction in which the first rollers are driven.

14. The method according to claim 13, wherein said step of reorienting the seed cotton includes contacting the seed cotton with a rotatably driven reorienting roller that is rotatably driven in the same direction as the direction in which the first rollers are driven.

15. The method according to claim 13, wherein said step of reorienting the seed cotton includes contacting the seed cotton with a rotatably driven reorienting roller that is rotatably driven at a peripheral speed that is greater than the peripheral speed at which the first rollers are driven.

16. The method according to claim 13, wherein said step of reorienting the seed cotton includes directing a pressurized air stream at the seed cotton located on the first rollers.

* * * * *